US007118521B2

(12) United States Patent
Borgstrom et al.

(10) Patent No.: US 7,118,521 B2
(45) Date of Patent: Oct. 10, 2006

(54) CENTRIFUGAL SEPARATOR WITH CONICAL PUMP INLET

(75) Inventors: Leonard Borgstrom, Tyreso (SE); Claes-Goran Carlsson, Tullinge (SE); Peter Franzen, Tullinge (SE); Claes Inge, Saltsjo-Duvnas (SE); Torgny Lagerstedt, Stockholm (SE); Hans Moberg, Stockholm (SE); Stefan Szepessy, Huddinge (SE)

(73) Assignee: Alfa Laval Corporate AB, Lund (SE)

( * ) Notice: Subject to any disclaimer, the term of this patent is extended or adjusted under 35 U.S.C. 154(b) by 0 days.

(21) Appl. No.: 10/506,757

(22) PCT Filed: Jan. 23, 2003

(86) PCT No.: PCT/SE03/00110

§ 371 (c)(1),
(2), (4) Date: Mar. 31, 2005

(87) PCT Pub. No.: WO03/080251

PCT Pub. Date: Oct. 2, 2003

(65) Prior Publication Data

US 2005/0170943 A1 Aug. 4, 2005

(30) Foreign Application Priority Data

Mar. 21, 2002 (SE) ..... 0200872

(51) Int. Cl.
*B04B 11/02* (2006.01)

(52) U.S. Cl. ..... 494/42; 494/65

(58) Field of Classification Search ..... 494/41–42, 494/46, 5–6, 35, 38, 50, 60, 62, 65, 68–70, 494/901; 210/121–122, 360.1
See application file for complete search history.

(56) References Cited

U.S. PATENT DOCUMENTS

| | | | | | |
|---|---|---|---|---|---|
| 791,496 | A | * | 6/1905 | Ponten | 494/42 |
| 1,050,720 | A | * | 1/1913 | Raaslof et al. | 494/42 |
| 1,056,233 | A | * | 3/1913 | Trent | 494/42 |
| 1,712,184 | A | * | 5/1929 | Wendel | 494/44 |
| 1,927,822 | A | * | 9/1933 | Coe | 494/27 |
| 2,881,974 | A | | 4/1959 | Ruf | |
| 2,928,592 | A | * | 3/1960 | Johnson | 494/35 |
| 3,424,375 | A | * | 1/1969 | Maurer | 494/4 |
| 3,633,749 | A | * | 1/1972 | Panosh | 210/121 |
| 3,674,196 | A | * | 7/1972 | Gutter | 494/60 |
| 3,756,505 | A | * | 9/1973 | Miachon | 494/22 |
| 3,768,726 | A | * | 10/1973 | Hale et al. | 494/10 |
| 4,220,279 | A | * | 9/1980 | Miachon | 494/22 |

(Continued)

FOREIGN PATENT DOCUMENTS

EP 0 047 677 3/1982

(Continued)

*Primary Examiner*—Charles E. Cooley
(74) *Attorney, Agent, or Firm*—Michaud-Duffy Group LLP

(57) ABSTRACT

A centrifugal separator has a centrifugal rotor that is rotatable about a vertical axis and has both a rotor body for separation of two liquids, having different densities, and a pumping member that is designed to pump via the outside of a conical body a mixture of said two liquids into the rotor body from a surface layer of a liquid body situated below the rotor body.

11 Claims, 1 Drawing Sheet

U.S. PATENT DOCUMENTS

| | | | | |
|---|---|---|---|---|
| 4,356,959 | A * | 11/1982 | Rosander | 494/60 |
| 4,522,766 | A | 6/1985 | Sunada | |
| 4,636,319 | A * | 1/1987 | Stroucken | 210/781 |
| 4,753,632 | A * | 6/1988 | Hofmann et al. | 494/43 |
| 5,484,282 | A * | 1/1996 | Trawoger et al. | 494/42 |
| 5,693,218 | A * | 12/1997 | Yamamoto et al. | 210/122 |
| 6,626,814 | B1 * | 9/2003 | Setterberg | 494/15 |
| 6,702,729 | B1 * | 3/2004 | Mazzuca | 494/26 |
| 6,802,804 | B1 * | 10/2004 | Stroucken | 494/37 |
| 6,905,611 | B1 * | 6/2005 | Gustafsson | 210/776 |
| 6,955,637 | B1 * | 10/2005 | Montano et al. | 494/42 |
| 2005/0170943 | A1 * | 8/2005 | Borgstrom et al. | 494/42 |

FOREIGN PATENT DOCUMENTS

| | | | |
|---|---|---|---|
| EP | 0164866 | * | 12/1985 |
| WO | 00/59640 | * | 10/2000 |
| WO | WO 00/59639 | | 10/2000 |
| WO | 03/080251 A1 | * | 10/2005 |

* cited by examiner

CENTRIFUGAL SEPARATOR WITH CONICAL PUMP INLET

CROSS-REFERENCE TO RELATED APPLICATIONS

This application is entitled to the benefit of and incorporates by reference essential subject matter disclosed in International Application No. PCT/SE03/00110 filed on Jan. 23, 2003 and Swedish Patent Application No. 0200872-0 filed on Mar. 21, 2002.

FIELD OF THE INVENTION

The present invention relates to a centrifugal separator including a centrifugal rotor arranged for rotation around a substantially vertical rotational axis, the centrifugal rotor having a rotor body, delimiting a separation chamber, and a pumping member, that is arranged to rotate with the rotor body and to extend during the operation of the centrifugal rotor downwardly from the rotor body and into a liquid body, situated under the rotor body, for pumping of liquid from the liquid body into the rotor body.

BACKGROUND OF THE INVENTION

A centrifugal separator of this kind may be used to remove from a liquid body having a free liquid surface a thin surface layer of the liquid body and thereafter directly separate from each other two liquids with different density, e.g. oil and water, included in the surface layer.

A previously known centrifugal rotor having a pumping member of the initially defined kind is shown and described in WO 00/59639 and WO 00/59640.

In WO 00/59639 a centrifugal rotor of the kind here in question is proposed to be used together with a special device for removal of a surface layer from a liquid body. The pumping member of the centrifugal rotor in this case is arranged to pump liquid into the rotor from the special device and, thus, not to pump liquid into the rotor directly from the liquid body. A special device of this kind makes the entire separation equipment complicated and expensive.

In WO 00/59640 a centrifugal rotor having a pumping member of the initially defined kind, instead, is proposed to be provided with a special sealing device adapted to prevent liquid being pumped up from the liquid body from flowing on the outside of the pumping member and being thrown back therefrom to the liquid body. This would cause turbulence in the surface layer of the liquid body to be removed therefrom and to be treated in the centrifugal rotor. Thus, also in this case a special device is required in addition to the actual pumping member, i.e. the sealing device, for the pumping of liquid into the centrifugal rotor.

Centrifugal rotors having pumping members, intended to operate substantially as those in WO 00/59639 and WO 00/59640 but having no special devices for removal of a surface layer from a liquid body and no special sealing devices, respectively, are shown and described in U.S. Pat. No. 3,424,375, GB 884 812 and CH 345 599.

A main object of the present invention is to provide a centrifugal separator having a simple and inexpensive centrifugal rotor of the initially defined kind. Another object is to provide such a centrifugal separator which can effectively remove a surface layer from a liquid body and pump ft into the centrifugal rotor without causing substantial turbulence in the surface layer while this is still on the liquid body.

SUMMARY OF THE INVENTION

These objects may be obtained by a centrifugal separator of the initially defined kind, having a pumping member on its outside that defines a pumping surface facing away from the rotational axis, extending substantially symmetrically around the rotational axis and being arranged to have contact with a free liquid surface on the liquid body in an area extending around the pumping member.

The pumping surface on the outside thereof, at least along a part of the axial extension of the pumping member, has a generatrix forming an angle with the rotational axis in a way such that the pumping member along the part of its axial extension has an increasing diameter from below and upwards, so that upon rotation of the rotor liquid will flow upwards from the free liquid surface on the outside of the pumping member.

The rotor delimits a receiving space situated so that it receives liquid that upon rotation of the rotor has been brought to flow upwards from the free liquid surface on the outside of the pumping member.

To make possible an acceptable pumping capacity without liquid, flowing upwards along the pumping surface, being thrown away from it, said generatrix should form an angle greater than 30° with the rotational axis. No benefit, as to pumping capacity is made at an angle exceeding about 35°. Preferably, the generatrix forms an angle of between 30° and 45°, preferably 35°, with the rotational axis.

In order to safely receive liquid which is pumped upwards along the pumping surface of the pumping member, the rotor body, during operation of the rotor, extends downwardly to a level such that the rotor body surrounds an upper part of the pumping surface somewhat above the free liquid surface.

It is possible to allow liquid being pumped upwards along the pumping surface to leave the pumping surface and be thrown some before being caught by the rotor body. However, to avoid unnecessary splitting of liquid components, which later shall be separated from each other in the centrifugal rotor, the pumping member has a continuous surface extending from the pumping surface into a part of the receiving space of the rotor, which is arranged to contain liquid during operation of the rotor. The liquid may then flow along this surface into the receiving space under as little turbulence as possible.

In this connection, it is previously known to use a conical pumping member to pump a liquid mixture of components upwards from the surface of a liquid body to cause separation of the components. Such technique is known for instance through SU 1 382 496 Al and SU 1 180 079 A. Here, though, the components are separated from each other by being thrown away from the conical pumping member at different axial levels thereof.

In a preferred embodiment of the invention a free liquid surface will be maintained in the separation chamber of the centrifugal rotor at a first radial distance from the rotational axis. For obtainment of a separation, as undisturbed as possible in the separation chamber, the receiving space preferably communicates with the separation chamber at a second radial distance from the rotational axis greater than the first radial distance.

According to the invention the centrifugal separator also includes a driving device for rotation of the centrifugal rotor. The centrifugal rotor and the pumping member may be separately supported by this driving device. However, in a practical embodiment of the invention, only the pumping member is connected directly with the driving device, so that it is supported thereby, whereas the rotor body is supported by the pumping member and thus only indirectly by the driving device. Then, the rotor body may be arranged to be removed from the pumping member, e.g. for cleaning, without the latter having to be released from the driving device.

In a preferred embodiment of the invention the separation chamber has two outlets at different radial distances from the rotational axis of the rotor for the respectively discharging of two separated liquids with different densities.

BRIEF DESCRIPTION OF THE DRAWINGS

The invention is described in the following with reference to the accompanying drawing, in which.

DETAILED DESCRIPTION OF THE PREFERRED EMBODIMENTS

Figure 1:
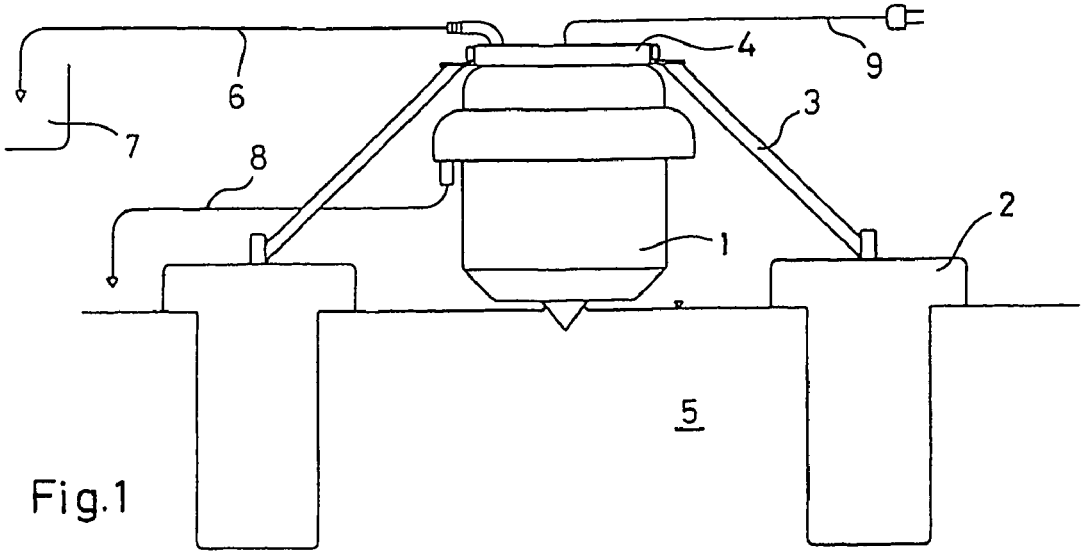
FIG. 1 shows a centrifugal separator according to the invention, supported on the surface of a liquid body by means of a number of floats.

FIG. 1 shows a centrifugal separator 1 supported by means of floats 2, bars 3 and a supporting member 4 directly above the surface of a liquid body 5. The liquid surface is illustrated by means of a small triangle. The centrifugal separator is arranged to remove, from the liquid body 5, a thin surface layer, comprising oil and water and to separate the oil and the water from each other. Separated oil is shown flowing through a pipe 6 to a collecting tank 7, whereas separated water is shown being reconducted to the liquid body through a conduit 8. An electrical connection 9 is shown as an illustration of how the centrifugal separator is meant to be driven.

Figure 2:
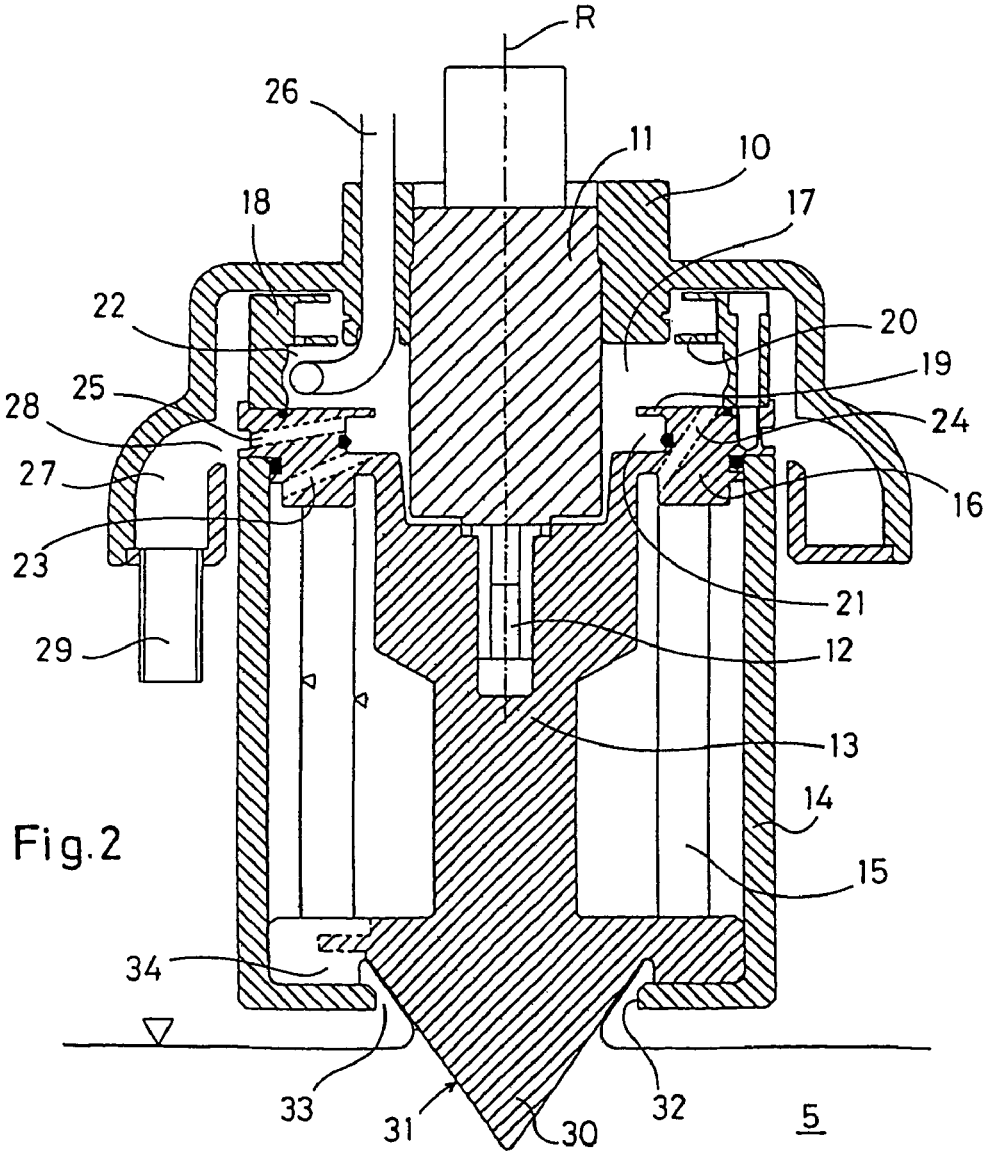
FIG. 2 shows an axial section through the centrifugal separator in FIG. 1.

FIG. 2 shows an axial section through the centrifugal separator 1 in FIG. 1. The centrifugal separator includes a stationary supporting device 10 that, in turn, is arranged to be supported by, and be suspended from, the supporting member 4 in the way as illustrated in FIG. 1. The supporting device 10 supports an electric motor 11, which has a downwardly directed driving shaft 12 arranged to rotate around a vertical rotational axis R. A central pumping member 13 is attached to the driving shaft 12 and extends downwardly such that its lowermost part dips down into the liquid body 5.

The pumping member 13 supports a rotor body 14 surrounding the pumping member and extending downwardly to a level just above the liquid surface of the liquid body 5. Between the pumping member 13 and the rotor body 14 a separation chamber 15 is delimited. An upper part of the pumping member 13 forms a partition 16 between the separation chamber 15 and a space 17 above the pumping member.

On top of the pumping member 13 a sleeve formed member 18 is mounted, surrounding the space 17. The partition 16 and the sleeve formed member 18 delimits, by means of radially inwardly directed annular flanges 19 and 20, two annular chambers 21 and 22, which constitute parts of the space 17. A first channel 23 extends through the partition 16 from a radially outer part of the separation chamber 15 to the annular chamber 21. A second channel 24 extends through the partition 16 from a radially inner part of the separation chamber 15 to the annular chamber 22.

The pumping member 13 (with its partition 16), the rotor body 14 and the sleeve formed member 18 form together a centrifugal rotor. The centrifugal rotor is rotatable by means of the driving shaft 12 of the motor 11. The upper part of the centrifugal rotor is surrounded by the stationary supporting device 10.

The annular chamber 21 has a draining channel 25 extending radially away from the chamber 21 through the partition 16 and opening on the outside of the centrifugal rotor just described. The annular chamber 22 may be drained by means of a stationary paring tube 26 extending from above through the supporting device 10 into the space 17 and further out in the chamber 22.

The stationary supporting device 10 forms an annular groove 27 extending all around the centrifugal rotor and opening towards the rotor through an annular slot 28 that is situated at the same axial level as the opening of the draining channel 25. The groove 27 has an outlet 29.

The lowermost part of the pumping member 13 is formed as a solid conical body 30 having a conical pumping surface 31. A part of the body 30 extends out through a downwardly facing central opening 32 in the rotor body 14. Only the tip of the part of the body 30 is dips down into the liquid body 5. A narrow annular slot 33 is left between the conical body 30 and the edge of the opening 32.

Just above the opening 32 the body 30 changes from being conical to being substantially disc shaped. A number of passages 34 distributed around the opening 32 extend from the opening 32 to the interior of the rotor body 14, i.e. to the separation chamber 15. The walls delimiting these passages 34 form flow surfaces for liquid to be pumped from the liquid body 5 into the separation chamber 15.

The apex angle of the conical body 30 is about 700, i.e. the generatrix of the conical pumping surface 31 forms an angle of about 35° with the rotational axis R of the rotor. This has proved to give a maximum liquid flow upon rotation of the pumping member at a certain speed.

The pumping surface of the pumping member does not necessarily have to be conical. The generatrix of the pumping surface may alternatively be curved, then preferably curved by a relatively large radius of curvature. Preferably, in that case, the generatrix forms an increasing angle with the rotational axis in a direction from the liquid body and upwards along the pumping surface for avoiding that liquid flowing on the pumping surface is thrown away therefrom. If desired, the lowermost part of the pumping member may have the shape of a frustum of a cone.

The above described centrifugal separator operates as follows in connection with cleaning of a water surface from a thin layer of oil floating on the water surface.

After the centrifugal separator, by means of the supporting equipment 24, has been adjusted to a suitable vertical height, so that the pumping member 13 has an optimum dipping depth in the liquid body 5, the motor 11 is started so that the centrifugal rotor is brought to rotate around the rotational axis R. This results in the pumping member 13 starting to pump liquid from the liquid body 5 along the conical surface 31 upwards through the liquid surface of the liquid body 5. The liquid will flow from below and upwards, above the liquid surface, in a thin layer on the conical surface 31. By the existing surface tension in the oil layer on the water surface, the oil layer will gradually move towards the pumping member and be pumped upwards thereby as a part of said layer on the conical surface 31.

When the pumped liquid layer on the surface 31 has reached the opening 32 in the rotor body 14, the layer flows further by means of the centrifugal force into the passages 34 serving as a receiving space in the centrifugal rotor for the mixture of water and oil. Through the passages 34 the liquid mixture flows further into the separation chamber 15, while being kept in rotation with the same rotational speed as the rotor body 14. The oil and the water are separated and form one layer each in the separation chamber 15, as shown in FIG. 2. Two small triangles show the boundary layer between air and oil (the radially inner triangle) and the boundary layer between oil and water (the radially outer triangle), respectively.

As can be seen, the inlet passages 34 open in the separation chamber 15 at a level radially outside the free liquid surface in the separation chamber. Preferably, the openings of the passages 34 in the separation chamber are situated at the same radial level as the boundary layer between oil and water.

At the upper part of the separation chamber 15 separated water flows through the channel 23 into the annular chamber 21 and therefrom further through the draining channel 25 and out in the groove 27 in the stationary supporting device 10. Through the outlet 29 the water is conducted back to the liquid body 5, preferably through a conduit, which opens somewhat below the liquid surface on the liquid body 5, so that no turbulence arises in the surface layer of oil around the centrifugal separator.

Separated oil flows through the channel 24 into the annular chamber 22, from where it is conducted out of the centrifugal rotor by means of the stationary paring tube 26 and further through the conduit 6 to the tank 7.

The drawing shows that the sleeve formed member 18 above the annular flange 20 has another such flange and that the member 18 together With these two flanges form an uppermost annular chamber similar to the annular chamber 22. There is also shown two small holes in the radially outermost part of the flange 20, through which liquid may be drained from said uppermost annular chamber to the chamber 22. The object of said uppermost annular chamber is to collect liquid, which may splash up from the chamber 22 through the interspace between the flange 20 and the stationary supporting device 10, which liquid thus may then be returned to the chamber 22. If required, as a further splash-collecting member, an annular flange, e.g. of flexible material, may be attached to the supporting device 10 (at an annular groove, shown in the drawing) and extend radially outwards some distance in said uppermost annular chamber. All splash of liquid out of the chamber 22 may be safely caught in this way.

What is claimed is:

1. A centrifugal separator including a centrifugal rotor arranged for rotation around a substantially vertical rotational axis (R), the centrifugal rotor having a rotor body, delimiting a separation chamber, and a pumping member, that is arranged to rotate with the rotor body and to extend during the operation of the centrifugal rotor downwardly from the rotor body and into a liquid body, situated under the rotor body, for pumping of liquid from the liquid body into the rotor body, the pumping member having on an outside thereof, a pumping surface facing away from the rotational axis (R), extending mainly rotational-symmetrically around the rotational axis (R) and contacting a free liquid surface on said liquid body in an area extending around the pumping member, the pumping surface on the outside of the pumping member, at least along a part of the axial extension of the pumping member in said area, having a generatrix forming an angle-with the rotational axis (R) such that the pumping member along said part of its axial extension defines increasing diameter from below and upwards, so that upon rotation of the rotor liquid will flow upwards from the free liquid surface on the outside of the pumping member, wherein the rotor delimits a receiving space situated so that it receives liquid that upon rotation of the rotor has been brought to flow upwards from the free liquid surface on the outside of the pumping member, and wherein the pumping member includes a continuous surface extending from the pumping surface into a part of the receiving space of the rotor.

2. A centrifugal separator according to claim 1, wherein said generatrix forms an angle greater than 30° with the rotational axis (R).

3. A centrifugal separator according to claim 1, wherein said generatrix forms art angle of about 35° with the rotational axis (R).

4. A centrifugal separator according to claim 1, wherein said generatrix forms an angle smaller than 45° with the rotational axis (R).

5. A centrifugal separator according to claim 1, wherein the rotor body, during operation of the centrifugal rotor, extends downwards to a level such that the rotor body surrounds an upper part of the pumping surface of the pumping member somewhat above the free liquid surface.

6. A centrifugal separator according to claim 1, wherein the continuous surface of the pumping member contains liquid during operation of the rotor.

7. A centrifugal separator according to claim 1, wherein means are arranged to maintain a free liquid surface in the separation chamber of the centrifugal rotor at a first radial distance from the rotational axis (R), said receiving space communicating with the separation chamber at a second radial distance from the rotational axis (R) greater than said first radial distance.

8. A centrifugal separator according to claim 1, wherein a driving device for rotation of the centrifugal rotor supports the pumping member, which in turn supports the rotor body.

9. A centrifugal separator according to claim 1, wherein the separation chamber has two outlets at different radial distances from the rotational axis (R) of the rotor for the respective of two separated liquids with different densities.

10. A centrifugal separator according to claim 1, wherein the pumping surface is comprised of a conical pumping surface closed towards the liquid surface.

11. A centrifugal separator according to claim 1, further including means for maintaining the pumping surface in continuous contact with the free liquid surface of the liquid body.

* * * * *